US011890514B2

(12) United States Patent
Beggs

(10) Patent No.: US 11,890,514 B2
(45) Date of Patent: Feb. 6, 2024

(54) METHOD AND APPARATUS FOR A STREET GOLF GAME

(71) Applicant: BZAM LLC, Woodland, CA (US)

(72) Inventor: Robert A. Beggs, Woodland, CA (US)

(73) Assignee: BZAM LLC, Woodland, CA (US)

( * ) Notice: Subject to any disclaimer, the term of this patent is extended or adjusted under 35 U.S.C. 154(b) by 0 days.

(21) Appl. No.: 17/435,080

(22) PCT Filed: May 7, 2020

(86) PCT No.: PCT/US2020/031757
§ 371 (c)(1),
(2) Date: Aug. 31, 2021

(87) PCT Pub. No.: WO2020/227460
PCT Pub. Date: Nov. 12, 2020

(65) Prior Publication Data

US 2022/0203182 A1 Jun. 30, 2022

Related U.S. Application Data

(60) Provisional application No. 62/845,478, filed on May 9, 2019.

(51) Int. Cl.
*A63B 53/04* (2015.01)
*A63B 57/40* (2015.01)
(Continued)

(52) U.S. Cl.
CPC ..... *A63B 53/042* (2020.08); *A63B 37/0005* (2013.01); *A63B 37/12* (2013.01);
(Continued)

(58) Field of Classification Search
CPC ..... A63B 67/02; A63B 57/40; A63B 37/12; A63B 37/0005; A63B 53/00;
(Continued)

(56) References Cited

U.S. PATENT DOCUMENTS 1,464,029 A * 8/1923 Coughtrie ..... A63B 69/3617 473/235
1,939,414 A * 12/1933 Sametz ..... A63B 69/3632 473/226

(Continued)

FOREIGN PATENT DOCUMENTS

CN 202366400 U 8/2012

OTHER PUBLICATIONS

Tejada Biarge, Diego, European Search Report for EP 20801608.9, European Patent Office, dated Oct. 17, 2022.

(Continued)

*Primary Examiner* — Sebastiano Passaniti
(74) *Attorney, Agent, or Firm* — Temmerman Law; Mathew J. Temmerman

(57) ABSTRACT

A method and an apparatus for playing golf on a hard surface comprises a replaceable striking pad attached to a conventional golf club head by means of at least one attachment means, a spiked ball, a portable ball trap to trap the spiked ball and an optional remotely controlled vehicle to position the portable ball trap. The replaceable striking pad includes a small lip at a bottom end on a front face and a holding ledge having substantially curved edges extending away from the bottom end of the front face. The holding ledge is adaptable to wrap around a bottom sole of the golf club head. The portable ball trap includes a thin flat platform with tapered edges, a central threaded pole positioned on the thin flat platform and a circular frame having a plurality of hinged tabs threaded to the central threaded pole.

17 Claims, 7 Drawing Sheets

(51) Int. Cl.

| | |
|---|---|
| ***A63B 60/00*** | (2015.01) |
| ***A63B 37/00*** | (2006.01) |
| ***A63B 53/08*** | (2015.01) |
| ***A63B 67/02*** | (2006.01) |
| ***A63B 60/52*** | (2015.01) |
| ***A63B 37/12*** | (2006.01) |
| ***A63B 53/02*** | (2015.01) |
| ***A63B 60/42*** | (2015.01) |

(52) U.S. Cl.
CPC ..... *A63B 53/02* (2013.01); *A63B 53/0487* (2013.01); *A63B 53/08* (2013.01); *A63B 57/40* (2015.10); *A63B 60/004* (2020.08); *A63B 60/42* (2015.10); *A63B 60/52* (2015.10); *A63B 67/02* (2013.01)

(58) Field of Classification Search
CPC . A63B 2102/32; A63B 69/36; A63B 69/3632; A63B 69/3638; A63B 69/3685; A63B 15/00; A63B 69/3655; A63B 71/02; A63B 2071/009; A63B 60/42; A63B 60/52; A63B 60/004; A63B 53/0487; A63B 53/08
USPC ..... 473/236, 226, 280, 281, 219, 223–225, 473/231, 242; 150/160; 269/285, 909
See application file for complete search history.

(56) References Cited

U.S. PATENT DOCUMENTS

| | | | | | |
|---|---|---|---|---|---|
| 2,495,679 | A * | 1/1950 | Abrecht | A63B 69/3617 | 101/379 |
| 3,075,773 | A * | 1/1963 | Kaufman | A63B 69/3632 | 116/284 |
| 3,184,240 | A * | 5/1965 | Gleeson | A63B 57/357 | 473/188 |
| 3,310,309 | A | 3/1967 | Moss | | |
| 3,437,341 | A * | 4/1969 | Hasten, Jr. | A63B 69/3632 | 473/236 |
| 3,478,799 | A | 11/1969 | Hoyt | | |
| 3,489,415 | A * | 1/1970 | Smith | A63B 69/3685 | 473/236 |
| 3,721,447 | A | 3/1973 | Lourderback | | |
| 3,810,633 | A * | 5/1974 | Scott, III | A63B 69/3685 | 473/240 |
| 3,900,198 | A | 8/1975 | Conner | | |
| 4,026,561 | A | 5/1977 | Baldrossi et al. | | |
| 4,577,867 | A | 3/1986 | Lenhart | | |
| 5,294,127 | A * | 3/1994 | Keelan | A63B 69/3638 | 473/226 |
| 5,364,103 | A | 11/1994 | Chen et al. | | |
| 5,429,360 | A * | 7/1995 | Capecci, Jr. | A63B 67/14 | 473/589 |
| 5,480,143 | A | 1/1996 | McMurry | | |
| 5,620,377 | A | 4/1997 | Glockner | | |
| 5,636,844 | A | 6/1997 | de Buys | | |
| RE35,596 | E * | 8/1997 | Diener | A63B 60/62 | 150/160 |
| 5,707,297 | A | 1/1998 | Shu | | |
| 5,913,709 | A | 6/1999 | Cyr et al. | | |
| 6,065,516 | A * | 5/2000 | Chang | A63B 60/62 | 150/160 |
| 6,260,250 | B1 * | 7/2001 | Hall | A63B 60/42 | 29/281.1 |
| 6,290,619 | B1 * | 9/2001 | Mayer, II | A63B 43/00 | 473/446 |
| 6,464,596 | B1 | 10/2002 | Belding | | |
| 6,596,837 | B2 | 7/2003 | Hogge et al. | | |
| 6,926,629 | B2 * | 8/2005 | Dehen | E01H 1/12 | 119/867 |
| 7,293,775 | B1 | 11/2007 | Donnely | | |
| 7,410,432 | B2 | 8/2008 | Dehen | | |
| 7,780,539 | B2 * | 8/2010 | Whitefield | A63B 57/40 | 473/106 |
| 7,984,910 | B1 * | 7/2011 | Nielsen | A63B 67/06 | 273/400 |
| 2001/0023835 | A1 * | 9/2001 | Besnard | A63B 60/62 | 150/160 |
| 2003/0148821 | A1 | 8/2003 | Morgan et al. | | |
| 2005/0079933 | A1 * | 4/2005 | Gagne | A63B 69/0026 | 473/446 |
| 2007/0015607 | A1 | 1/2007 | Hot | | |
| 2007/0259728 | A1 | 11/2007 | Whitefield | | |
| 2007/0270233 | A1 | 11/2007 | Ruston | | |
| 2008/0035255 | A1 * | 2/2008 | Wu | A63B 60/62 | 150/160 |
| 2010/0255924 | A1 | 10/2010 | Parks | | |
| 2012/0058843 | A1 * | 3/2012 | Neufeld | A63B 59/70 | 473/563 |
| 2017/0157487 | A1 | 6/2017 | Faucette | | |

OTHER PUBLICATIONS

Tejada Biarge, Diego, Supplemental Partial European Search Report for EP 20801608, European Patent Office, dated May 24, 2022.

* cited by examiner

METHOD AND APPARATUS FOR A STREET GOLF GAME

RELATED APPLICATIONS

This application is a 35 U.S.C. 371 National State Entry of International Application No. PCT/US2020/031757, filed May 7, 2020, and claims the benefit of U.S. Provisional Patent Application 62/845,478, filed May 9, 2019, each of which is incorporated herein by reference in its entirety for all purposes.

BACKGROUND OF THE DISCLOSURE

Technical Field of the Disclosure

The present invention relates generally to golf gaming systems, and more specifically to a method and apparatus for playing versions of the game of golf on a street or other hard outdoor surface.

Description of the Related Art

Golf, a game popular for centuries, is conventionally played on grass-covered courses. Attempts have been made to play golf in an urban environment. Urban golf is typically played with conventional clubs and foam golf balls or tennis balls. The foam golf balls are light and soft enough to minimize the potential for impact damage to urban objects. The play uses conventional golf iron clubs, and the shots are off grass, sand, or short strips of synthetic grass mat placed on harder surfaces. Tennis balls are sometimes hit directly off a street, with the club head kept above the street surface. Targets are often designated from the urban landscape. However, urban golf is limited by not being able to play clubs directly in contact with the street surface, not having balls that combine damage prevention with reasonable travel distance and controlled rolling resistance and a lack of an improved putting target.

A conventional golf club cover is a slip-on fully enclosing cover to protect a golf club head from random contact with hard surfaces during transport or storage. Most commonly, this is to protect from contact with other golf clubs in a golf bag during bag transport between shots or otherwise during travel. Such covers are typically constructed from flexible material that would not stay firmly fastened to the club head if struck purposely on a hard surface such as a street. Movement would cause undesirable irregularities and inconsistency in both the impact imparted on the ball and in the friction or grab between the cover and the street. These covers are also not designed to withstand the impact and abrasion of golf play on a street.

Some golf club heads have been constructed with special face plates to produce sound or have special pointing devices or other features for practice. Such pointing devices are fastened onto the rear of a specific style of putter for putting aim practice feedback.

There is thus a need for means to protect the golf club head and a hard play surface from damage when attempting to strike a ball off a hard surface such as a street.

Some advancements have been made to develop short flight golf balls soft and light enough to be used for the game of golf in back yards and parks without risk of impact damage to people and objects. However, the most readily accessible open space near where most people live is the roadway or street, and thus further adaptations are required.

Some such existing short flight golf balls are described with short course versions of golf played with foam balls in large yards or other grass covered areas. The lightweight balls have ranges of about 50 to 70 feet. In one version, the ball comprises a core surrounded by foam with reticulated resinous veins to provide aerodynamic drag. Another golf game apparatus describes the use of a large 5-inch diameter foam ball and oversize clubs to play "soft golf" on a special short course. Some other existing balls for golf game include a winged short-flight ball for golf practice and hollow plastic shell golf balls for backyard play.

While suitable for play in limited space grass-covered areas, the balls described and suggested by the prior art may roll too easily on hard surfaces such as the street, which poorly simulates actual golf play. Such balls typically end up rolling off the street into the side gutter and often into drain inlets.

In addition to undesirable roll characteristics, prior art balls do not provide the desired flight characteristics. Balls with outer foam layers have less rebound when struck, do not bounce well and do not have controlled stopping characteristics when rolling. The solution of using lightweight materials comprised entirely of foam yields balls too light to provide a satisfying feel or adequate travel distance when struck. Balls with resinous veins or fibers on the outside tend to gather dirt, sand, and small plant fibers found in streets, changing their characteristics.

Plastic and elastomer balls with spikes are readily available as animal chew toys and for toss style games, however, the current commercially available balls either offer far too little or far too much rolling resistance to be useful for street golf. Most are also too light or too soft to provide the flight distance or hitting sensation appropriate for street golf. Some have spike shapes with edges that are not conducive to smooth directional rolling. There is thus a need for an improved ball for street, roadway or other hard surface use.

Conventional putting targets comprising roll up/tilt over tabs or sloped ramps leading to a dropped hole may be used for playing golf in the street. Such targets provide a less satisfying experience and limited simulation of real golf on grass. Most commercially available putting targets require a certain amount of incline to engage the trapping mechanism for the ball, thereby distorting the roll path of a ball. For a ball that is lighter than a conventional golf ball, conventional putting targets can even cause a backwards rejection style reaction to a putted ball.

There is thus a need for a method and apparatus for playing golf on a hard surface that includes a replaceable striking pad and an improved ball, further enhanced with a ball trap with minimal incline. Such a method and apparatus would provide a replaceable striking pad that would protect a golf club head and a hard play surface from damage when the golf club head is used to strike a ball off the hard surface. Such a striking pad would be firmly attached to the club head and would not cause irregularities and inconsistency on the ball due to the friction between the striking pad and the street. Such an apparatus would provide an improved ball for street, roadway or another hard surface use. Such an apparatus would also provide a ball trap with minimal incline to capture the ball. More accurate simulation of the sequential hole play nature of golf may also include a remotely controlled ball trap. Such a method and apparatus would allow playing forms of golf on streets or other hard surfaces in an urban environment. The present embodiment overcomes shortcomings in the field by accomplishing these critical objectives.

SUMMARY OF THE DISCLOSURE

To minimize the limitations found in the existing systems and methods, and to minimize other limitations that will be apparent upon the reading of this specification, a preferred embodiment of the present invention provides a method and an apparatus for playing golf on a hard surface.

The apparatus comprises a replaceable striking pad, a ball optimized for street play, an optional portable ball trap and an optional remotely controlled vehicle. The replaceable striking pad is attached to a conventional golf club head via at least one vertically adjustable attachment means. The at least one attachment means includes a clamp and tightening means. The replaceable striking pad includes a top end, a bottom end, a flat front face, a back face, a small rounded lip at the bottom end on the front face and a bottom end street impact surface/holding ledge extending away from the bottom end of the front face towards the back face and adaptable to wrap laterally around a bottom edge of the golf club head. The replaceable striking pad is firmly coupled to the golf club head to protect the sole of the club head from impact and abrasion damage when used on the hard surface. The ball includes a plurality of spikes on the surface of the ball. The plurality of spikes is designed to provide a lifting of the ball core above the hard playing surface and to provide the desired rolling resistance. The lifting of the ball core above the surface provides space to allow the front lower face and lip of the striking pad to contact the lower portion of the ball core when the golf club is properly swung. The portable ball trap includes a thin flat platform with tapered edges, a central threaded pole positioned on the thin flat platform and a circular frame having a plurality of hinged tabs threaded to the central threaded pole. The plurality of hinged tabs is lightweight and hangs down from the circular frame elevated off the surface of the thin flat platform. The portable ball trap is adaptable to hold and trap the spiked ball and prevents backward motion. The remotely controlled vehicle having a tow strap is configured to remotely position the portable ball trap on the hard surface.

The method for playing golf on a hard surface comprises the steps of: providing an apparatus for playing golf having a replaceable striking pad attached to a conventional golf club head, a spiked ball, a portable ball trap and an optional remotely controlled vehicle. The portable ball trap is positioned on the hard surface utilizing the remotely controlled vehicle and positioning the spiked ball on the hard surface at a suitable distance from the initial tee-off position of the spiked ball. The golf club head with the replaceable striking pad is swung in a manner similar to conventional golf such that the front face of the striking pad hits the spiked ball, with the lip contacting the lower underside portion of the ball core. Trapping the projected spiked ball is by the portable ball trap positioned on the hard surface A first objective of the present embodiment is to provide a method and an apparatus for playing golf on a hard surface that includes a replaceable striking pad and an improved ball.

A second objective of the present embodiment is to provide a method and an apparatus that provides a replaceable striking pad that protects a golf club head and a hard play surface from damage when the golf club head is used to strike a ball off the hard surface.

A third objective of the present embodiment is to provide a striking pad that is firmly attached to the club head and does not cause irregularities and inconsistency on the ball and in the friction between the striking pad and the street.

A fourth objective of the present embodiment is to provide an improved ball for street, roadway or another hard surface use.

A fifth objective of the present embodiment is to provide a ball trap with minimal entry incline to capture the ball.

Another objective of the present embodiment is to provide a method and apparatus that allows playing golf on a hard surface utilizing a replaceable striking pad, an improved ball and an improved ball trap.

Another objective of the present embodiment is to provide an optional means for moving the ball trap remotely.

These and other advantages and features of the present invention are described with specificity so as to make the present invention understandable to one of ordinary skill in the art.

BRIEF DESCRIPTION OF THE DRAWINGS

In order to enhance their clarity and improve the understanding of the various elements and embodiment, elements in the figures have not necessarily been drawn to scale. Furthermore, elements that are known to be common and well understood to those in the industry are not depicted in order to provide a clear view of the various embodiments of the invention. Thus, the drawings are generalized in form in the interest of clarity and conciseness.

DETAILED DESCRIPTION OF THE DRAWINGS

Figure 1:
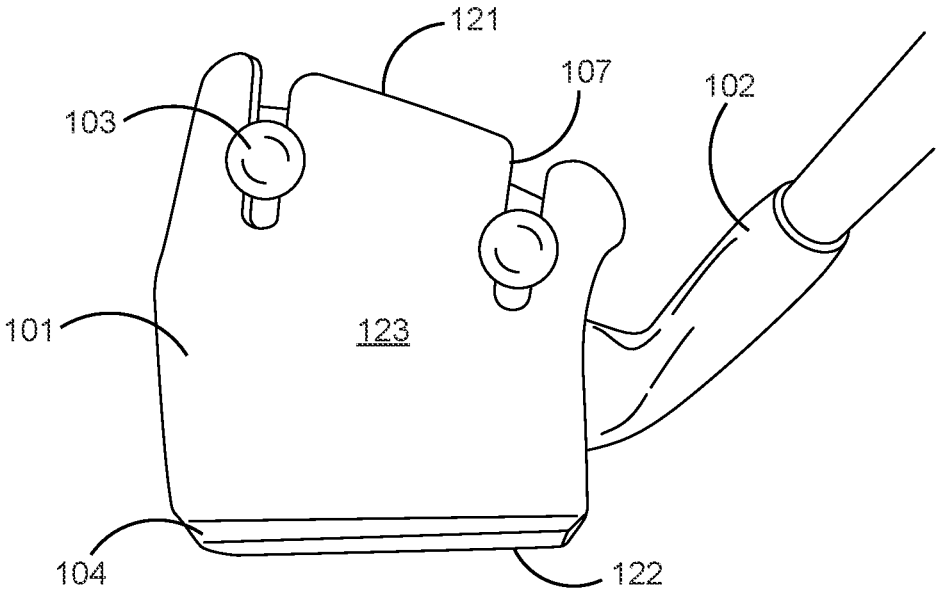
FIG. 1 illustrates a front perspective view of a replaceable striking pad attached to a conventional golf club head in accordance with the preferred embodiment of the present invention.

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized, and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" means +/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

Referring to FIGS. 1-13, perspective views of an apparatus for playing golf on a hard surface are illustrated. The apparatus comprises at a minimum a replaceable striking pad 101 and a ball with suitable characteristics 110. For full play of golf including the putting phase, a portable ball trap 117 and an optional remotely controlled vehicle 115 are included. The replaceable, abrasion-resistant striking pad 101 is firmly attached to a conventional golf club head 102 to allow the striking of the spiked ball 110 on the hard surface. When struck in the proper manner, the spiked ball 110 flies and rolls toward the portable ball trap 117 that captures the accurately directed ball 110, simulating a golf course hole. The present invention allows play off on the hard surface such as a street while providing a more accurate simulation of the feel and strategy of golf.

Figure 2:
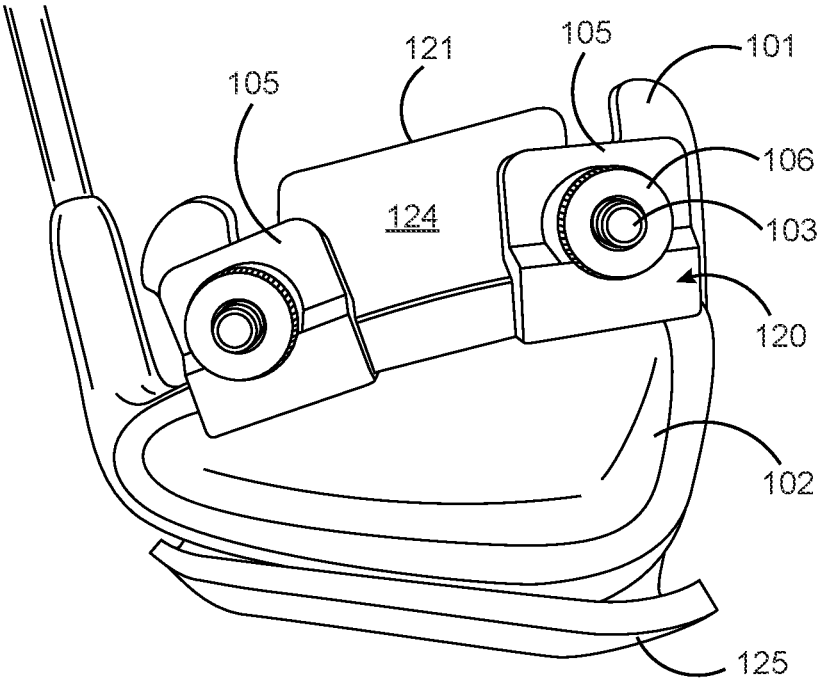
FIG. 2 illustrates a back perspective view of the replaceable striking pad attached to the conventional golf club head utilizing an attachment means in accordance with the preferred embodiment of the present invention.
Figure 3:
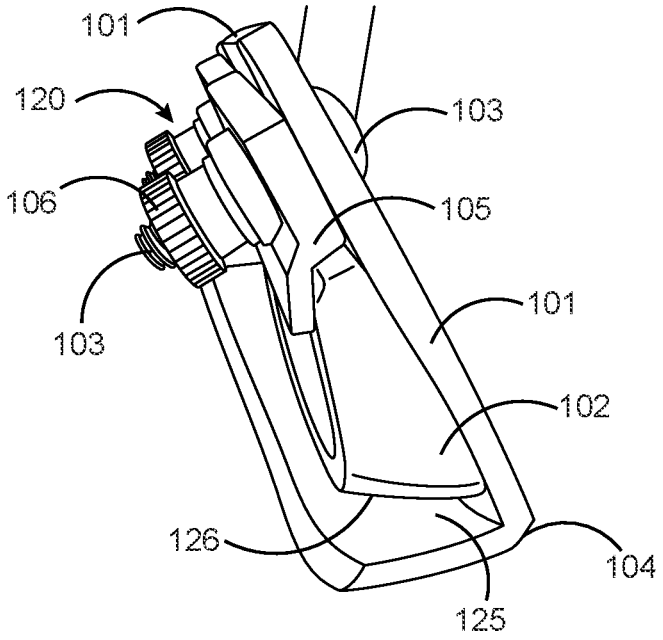
FIG. 3 illustrates a front outside end perspective view of the striking pad attached to the conventional golf club head in accordance with the preferred embodiment of the present invention.

FIGS. 1-3 illustrate the replaceable striking pad 101 attached to the golf club head 102 by means of at least one attachment means 120. The at least one attachment 120 means includes a clamp 105, a bolt 103 or other shaft with a head engaging the flat front face 123 and a nut 106 or other tensioning means for fastening to the upper back of the golf club head. One or more slots 107 in the upper part of the face of the striking pad provide vertical adjustability for the attachment means 120 to accommodate differing heights of golf club heads.

As best seen in front perspective view FIG. 1, the replaceable striking pad 101 includes a top end 121, a bottom end 122, a flat front face 123, a back face 124, and a small rounded lip 104 at the bottom end 122 on the front face 123. As best seen in FIG. 2, the replaceable striking pad includes a holding ledge 125 having laterally curved bottom edges and extending away from the bottom end 122 of the front face 123 towards the back of the golf club head 102. The holding ledge 125 is adaptable to extend around a bottom front edge 126 of the golf club head 102 and includes curved transitions at the sides to lessen the potential for the side edges to grab excessively when contacting a play surface. The small rounded lip 104 protrudes out from the bottom end 122 on the front face 123 of the striking pad 101. The small rounded lip 104 enables improved contact with the underside of the spiked ball 110 and better ball loft.

The replaceable striking pad 101 is abrasion-resistant and firmly attached to the conventional iron golf club head 102 to protect the bottom sole 126 of the club head 102 from impact and abrasion damage when used on the hard surface. The shape of the replaceable striking pad 101 including the holding ledge 125 allows the club head 102 to snugly fit therein, yet still allows some side tilt adjustment to better accommodate variability in golf club heads and the golfers' natural contact angle with the ground. The face of the replaceable striking pad 101 further fits the golf club head 102 to provide the correct club face angle for contacting the spiked ball 110.

The replaceable striking pad 101 is preferably made from a material with high toughness, good wear resistance, and relatively low coefficient of friction. In some embodiments, the striking pad is made from a material with high toughness with ISO 179 Charpy notched impact of greater than 10 kJ/m at 23 degrees C., high wear resistance and a dynamic coefficient of friction less than 0.5 when tested on steel. For example, the material of the replaceable striking pad 101 can be selected from a group including, but not limited to, engineering plastics such as impact modified nylon, polypropylene block copolymer, and high molecular weight polyethylene.

The replaceable striking pad 101 is firmly attached to the golf club head 102 via the removable clamps 105 with suitable bolts 103 and nuts 106, or other fasteners can be used. Referring to FIG. 2, the two clamps 105 that engage the top and back sides of the club head 102 firmly attach the striking pad 101 to the club head 102. In an alternative embodiment, one clamp with two sides to contact the top and back sides of the club head may be used, but it may not fit as well on the variety of club heads and club head dimensions common to conventional golf clubs. In one embodiment, the carriage bolt style fasteners 103 have shown a minimal appearance on the front face of the striking pad and allow simple thumb tightened nuts 106 to be used for applying tension to the fasteners 103 and compression on the back side of the club head 102 and clamps 105. Springsnap or adjustable throw-lever fasteners may also be used in alternative embodiments for fastening the clamps 105. Other suitable fasteners may be used that engage the striking pad front face and provide compression to separate or integral clamps engaging the back side of the club head. In another alternative embodiment, the striking pad 101 extends further around the back of the club head 102 from the top or bottom with ends pulled together by fasteners, although this would not counteract the drag forces on the bottom of the striking pad holding ledge during impact as well as the preferred embodiment and would sacrifice vertical adjustability.

The preferred golf club head 102 for street golf is an iron style club. Wood or hybrid style clubs may also be used. In an alternative embodiment of the invention, the striking pad 101 for wood or hybrid clubs extends over the top of the clubs and clamps around the back lobe of the clubs in the same manner as the striking pad 101 for iron club clamps around the top and upper back of the face of the iron club head 102 according to the preferred embodiment.

FIG. 3 illustrates an outside front end perspective view of the replaceable striking pad 101 attached to the golf club head 102. The striking pad 101 extends from the top end 121 through the attachment means 120 to the bottom end 122, covers down the face of the golf club head 102 and wraps around the bottom sole 126 of the club head 102. The holding ledge 125 of the striking pad 101 is set snug against the sole 126 of the club head 102 and held in position by restraint imparted at the top end 121 of the striking pad 101 when the attachment means 120 is set.

The replaceable striking pad 101 set in this manner resists the drag forces on the bottom end 122 of the striking pad 101 when in contact with the street or hard surface. The striking pad 101 protects the club head 102 and the street from damage when street golf is played. The striking pad 101 is designed to be simple and easy to replace when needed due to wear.

Figure 4:
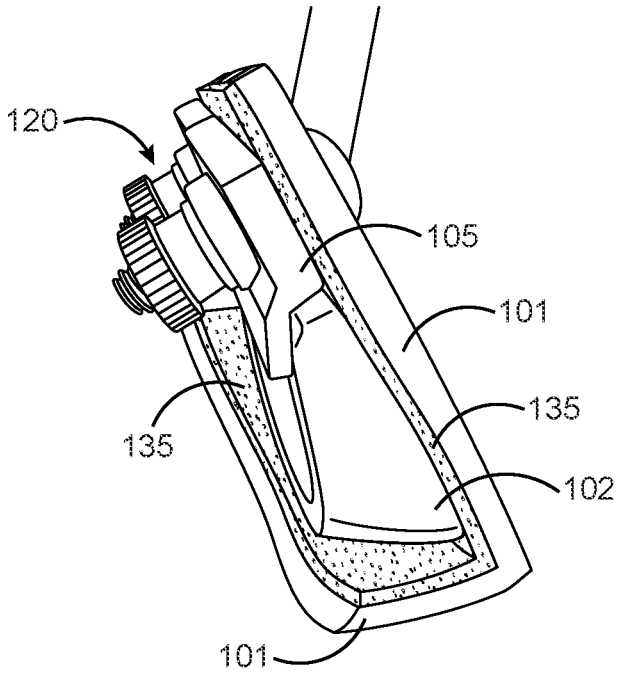
FIG. 4 illustrates a front outside end perspective view of a striking pad having an elastomeric layer in between the striking pad and the golf club head in accordance with one embodiment of the present invention.

FIG. 4. illustrates an outside front end perspective view of one embodiment of a striking pad 101 having an elastomeric layer 135 in between the striking pad 101 and the golf club head 102. The elastomeric layer 135 provides dampening for the golfer, and improves the life of the striking pad 101 by dampening some of the forces on it. For example, in some situations, additional cushion between the golf club head 102 and striking pad 101 are desirable. Such situations could include golfers that have a tendency to overstrike the ground or for cold conditions when the toughness of the striking pad material could be compromised. For such situations, the elastomeric layer 135 is added to the inside of the striking pad 101 where it contacts the club head 102 as shown in FIG. 4.

Figure 5:
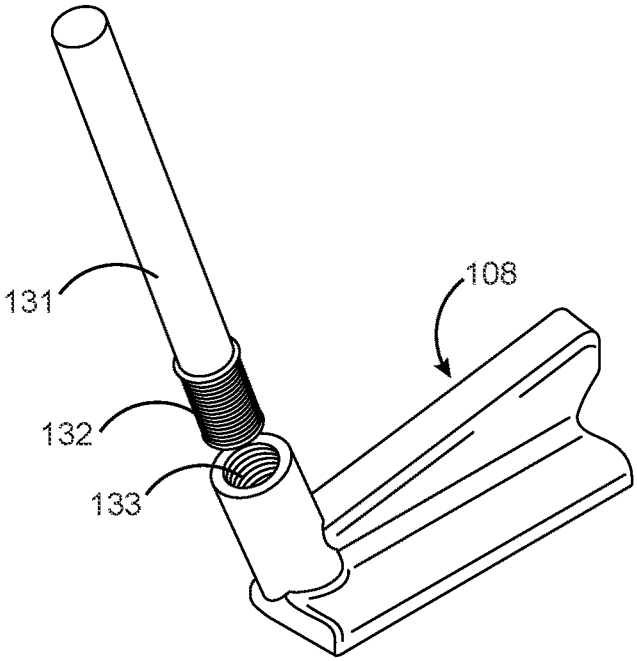
FIG. 5 illustrates a front outside end perspective view of a replaceable sacrificial club head that serves both as the striking pad and as the club head in accordance with an alternate embodiment of the present invention.

FIG. 5 illustrates an alternate embodiment of the striking pad 101 that serves as both as the striking pad 101 and the club head 102. This alternate embodiment includes a replaceable sacrificial club head 108 having a threaded end 133 which can be directly threaded to a shaft threaded end 132 of a threaded golf club shaft 131. As the game of golf is often played on tarmac or a sidewalk, the golf club head 102 would be worn out with use, and eventually needs replacement. In such situations, the replaceable sacrificial club head 108 can be unscrewed from the threaded golf shaft 131 and replaced with a new one. In this alternate embodiment, the threaded end 133 has a left handed thread which prevents the replaceable sacrificial club head 108 from unscrewing when swung to the left by a right handed golfer. These approaches, however, would not allow players to utilize the standard clubs they already own or could readily obtain, and the clubs would not be as suitable for use on both the conventional golf course and for street golf.

Figure 6:
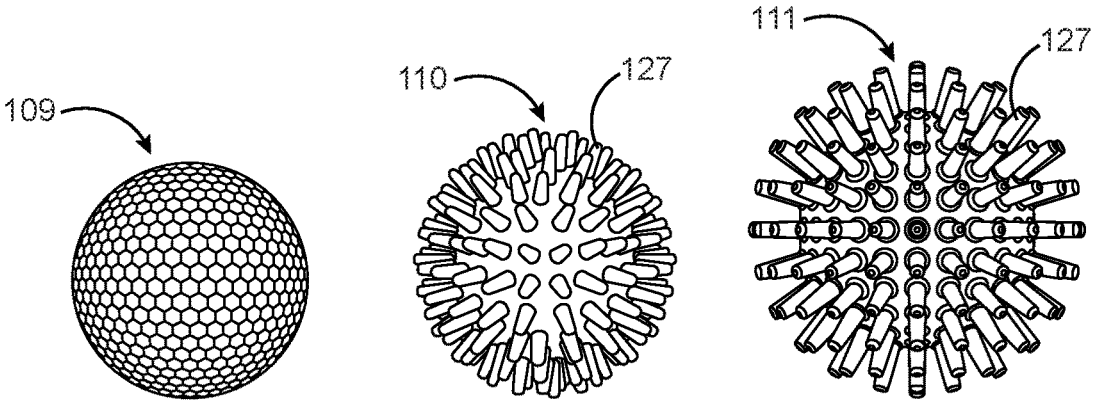
FIG. 6 illustrates a perspective view of a conventional golf ball and two variations of a spiked ball in accordance with the preferred embodiment of the present invention.

Referring to FIG. 6, perspective view of a conventional golf ball 109 and two embodiments of the spiked ball 110, 111 are illustrated. The spiked ball 110 includes a plurality of spikes 127 on the surface of the ball 110. The plurality of spikes 127 is designed to provide a lifting of the ball 110 core off the playing surface and provide the desired rolling resistance. The lifting of the ball core above the surface provides space to allow the front lip of the striking pad to contact the underside portion of the ball core when the golf club is properly swung. One embodiment provides a soft-spiked ball 110 with light to moderate rolling resistance and another embodiment provides a soft-spiked ball 111 with greater rolling resistance. The two embodiments of the spiked balls 110, 111 are designed specifically for use on the street or other hard surface. The elasticity, softness and outer construction prevent damage to cars and other items in or near the street when impacted by the ball 110. In the preferred embodiment, the spiked ball 110 consists of a single piece molded elastic core with the plurality of surrounding flexible elastic spikes 127. In an alternative embodiment, the core is hollow. For best matching with the real game of golf, the preferred embodiment of the spiked ball 110 has a core diameter slightly smaller than the conventional golf ball 109 and an outside diameter of the plurality of spikes 127 slightly larger than the conventional golf ball 109. The plurality of spikes 127 lift the core of the spiked ball 110 approximately 3 mm or more off a flat surface to allow the bottom end 122 of the striking pad 101 to strike below or near the bottom of the ball core for a proper swing. Alternate embodiments include different sized balls and lift characteristics as desired.

A sufficient number of the plurality of spikes 127 oriented as uniformly as reasonably possible consistent with manufacturing limitations around the ball core provides smooth and straight rolling character. Providing spikes with circular cross sections further enhances the smooth rolling characteristics of the ball. When the spiked ball 110 is rolling, the plurality of flexible spikes 127 also absorbs some of the irregularities in the asphalt or other slightly uneven surface to provide smooth rolling character. Thus, in this manner, the spiked ball 110 provides the functionality of both the ball and the grass experienced at a golf course, with the spikes on the ball simulating the effect of grass on the roll and bounce of the ball.

Figure 7:
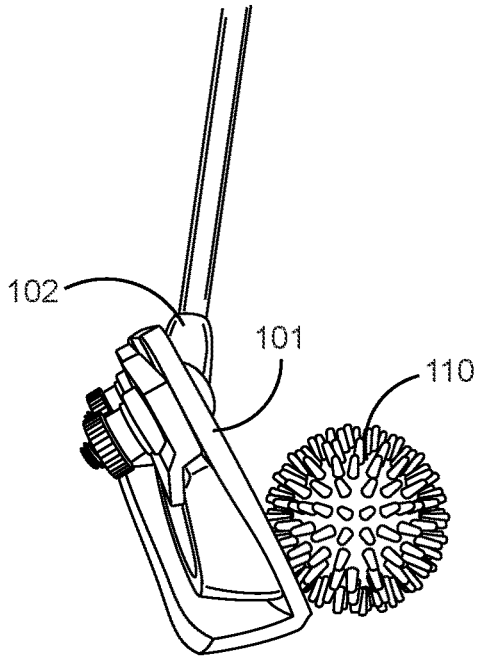
FIG. 7 illustrates a front outside end perspective view of the golf club head covered with the striking pad striking the spiked ball in accordance with the preferred embodiment of the present invention.

Turning to FIG. 7, the spiked ball 110 being struck by the golf club head 102 covered with the striking pad 101 is illustrated. The spiked ball 110 is specifically designed to be played off the hard surface while having desirable bounce and roll characteristics. The rolling resistance characteristics of the spiked ball 110 can be selected from the flexible spike dimensions and material properties to provide a similar sensation to the various grass heights and types of hits in a regular game of golf. For example, a ball 110 with relatively shorter or stiffer spikes is suitable for use in putting or other shots where more rolling is acceptable, whereas a ball 111 with more flexible or longer spikes simulates fairway, rough, or approach shots. An additional purpose of controlled rolling resistance is to keep the ball 110 from rolling too easily down sloping streets or into the street side gutter. Most of the time it is desirable to use the ball 110 with an effective coefficient of static friction sufficiently high to hold the ball 110 on approximately a 5 percent slope of asphalt, which is the typical side slope of streets near gutters. In some areas, street slopes may be over 10 percent, and it is desirable to have the ball 110 that rolls to a halt rather than rolling away in those situations. An alternative embodiment of the ball 110 with less rolling resistance could be used for situations where rolling resistance is not as important, such as on a large flat area like a parking lot.

Figure 8:
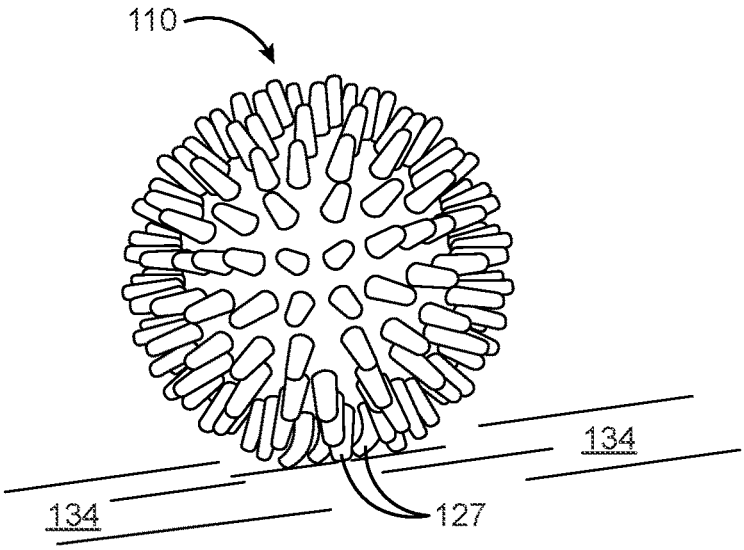
FIG. 8 illustrates a side view of the spiked ball on an incline showing partial buckling of a plurality of spikes to provide rolling resistance in accordance with the preferred embodiment of the present invention.

FIG. 8 illustrates the spiked ball 110 on an incline 134 showing partial buckling of the plurality of spikes 127 to provide the rolling resistance. The plurality of spikes 127 on the spiked ball 110 buckle partially where they come in contact with a surface, such as the ground shown here, allowing a reasonable roll but absorbing energy and stopping the spiked ball 110 more rapidly as the ball velocity slows. Furthermore, as the spiked ball 110 is about to stop, the translational energy is converted to rotational energy causing the spiked ball 110 to spin on its own vertical axis to further remove the kinetic energy and minimize over-roll. Spike buckling can be approximately modeled in a similar manner as the buckling of columns where properties such as length, area, moment of inertia, and material modulus determine the force needed to initiate buckling. Prototype testing on an adjustable inclined plane surface provides a measure of slope holding performance allowing spike dimensions and material modulus selection to be modeled to provide ball designs with the desirable properties. Spike buckling also provides additional cushion to protect cars and other urban objects from damage when inadvertently struck by the spiked ball.

Some amount of bounce upon landing is desirable to simulate the typical 0.5 to 3-meter range of first bounce height of golf balls on courses proportioned to flight distance. One embodiment exhibits 25% to 50% rebound when dropped a meter onto a hard surface. In other embodiments less than 25% or more than 50% rebound occurs. For the street golf game, the spiked ball 110 may be swapped in place by players to provide preferred characteristics for each shot in the same manner as clubs are selected for each shot on a conventional golf course.

The spiked ball 110 of the present invention provides an improved travel distance and controlled rolling resistance to lessen the instances of the spiked ball 110 ending up in gutters, drains, and rolling away down sloped streets. The spiked ball 110 has more abrupt stopping from a low velocity to enable better ball placement and gives better bounce and rebound when landing from an airborne trajectory than a foam-covered ball would have. Moreover, the spiked ball 110 provides a straighter rolling direction and less chatter and small scale bouncing when rolling on an uneven surface such as asphalt.

Figure 9:
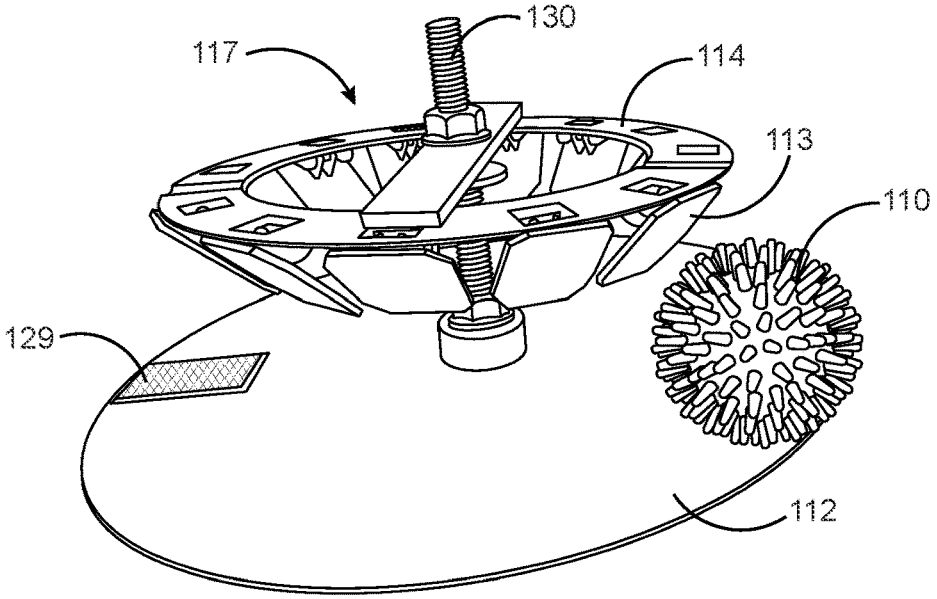
FIG. 9 illustrates a side perspective view of a portable ball trap with the ball outside the portable ball trap in accordance with the preferred embodiment of the present invention.
Figure 10:
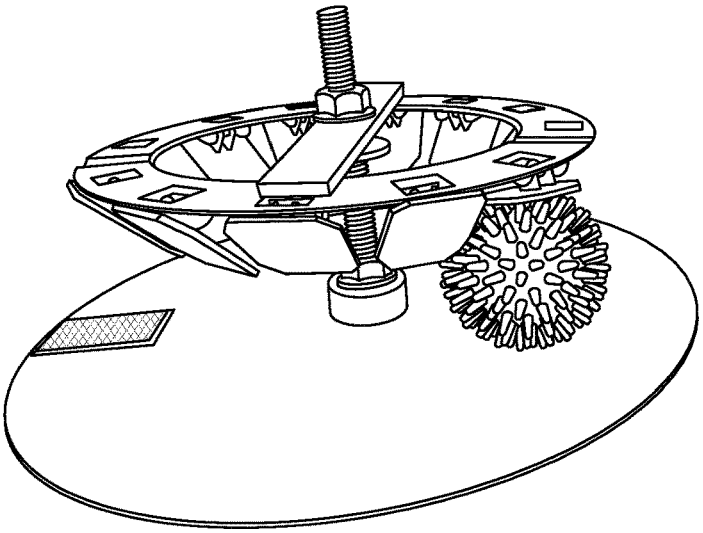
FIG. 10 illustrates a side perspective view of the ball entering the portable ball trap in accordance with the preferred embodiment of the present invention.
Figure 11:
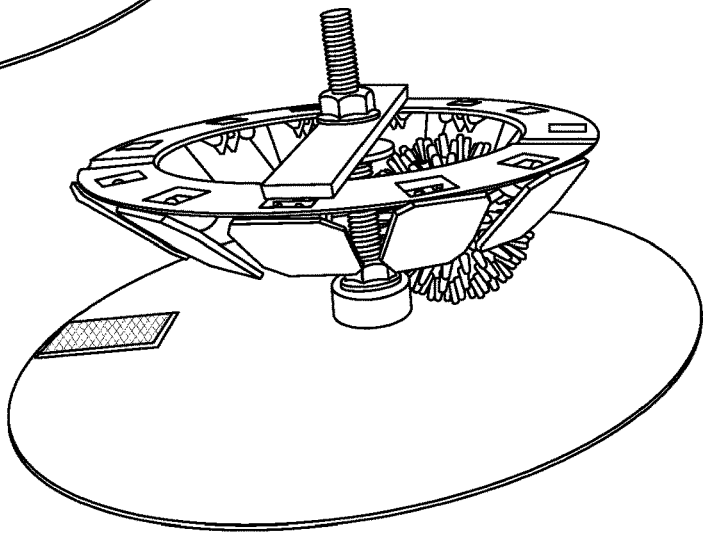
FIG. 11 illustrates a side perspective view of the ball trapped inside the portable ball trap in accordance with the preferred embodiment of the present invention.

Referring to FIGS. 9-11, an embodiment including a suitable portable ball trap 117 capturing the spiked ball 110 is illustrated. The portable ball trap 117 includes a thin flat platform 112 with tapered edges, a central threaded pole 130 positioned on the thin flat platform 112 and a circular frame 114 having a plurality of hinged tabs 113 threaded to the central threaded pole 130. The plurality of hinged tabs 113 is lightweight and hangs down from the circular frame 114 elevated off the surface of the thin flat platform 112. The portable ball trap 117 is adaptable to hold and trap the spiked ball 110 and prevents backward motion. The travel of the plurality of hinged tabs 113 toward the center of the central threaded pole 130 is not restrained, allowing the spiked ball 110 to pass from outside the plurality of hinged tabs 113 into the portable ball trap 117. However, the backward movement of the plurality of hinged tabs 113 is prevented by interference between the tabs 113 and the circular frame 114, thereby stopping the spiked ball 110 that is impacting the plurality of hinged tabs 113 from the inside of the portable ball trap 117. In this manner, the spiked ball 110 enters the portable ball trap 117 through the thin flat platform 112 with tapered edges, passes under the plurality of hinged tabs 113, and then becomes trapped as illustrated in FIGS. 10 and 11. The portable ball trap 117 of the present invention eliminates the deceleration, travel path distortion, and backwards rejection that occur with most prior art devices. The thin flat platform 112 of the portable ball trap 117 has an outline to enable smooth towing, is thin while still providing adequate support, and has a tapered outside edge for ease of the ball 110 rolling onto the thin flat platform 112 and towards the plurality of hinged tabs 113. The thinness and tapered outside edge minimize undesirable effects on the translational velocity and direction of the ball 110.

The portable ball trap 117 for the street golf game of the present invention provides a preferably portable trap 117 which can be easily positioned on any surface and effectively captures the ball 110 hit into its effective capture diameter. The thin flat platform 112 of the portable ball trap 117 provides a nearly flat approach path, both for level placement of the portable ball trap 117 on the street surface and to impart a minimal effect on the ball trajectory as it nears the portable ball trap 117. The portable ball trap 117 preferably traps the spiked ball 110 using a minimal amount of the ball's translational energy while assuring a secure trapping and also does not distort the ball trajectory or cause a backward rejection style reaction to the entered ball 110.

Figure 12:
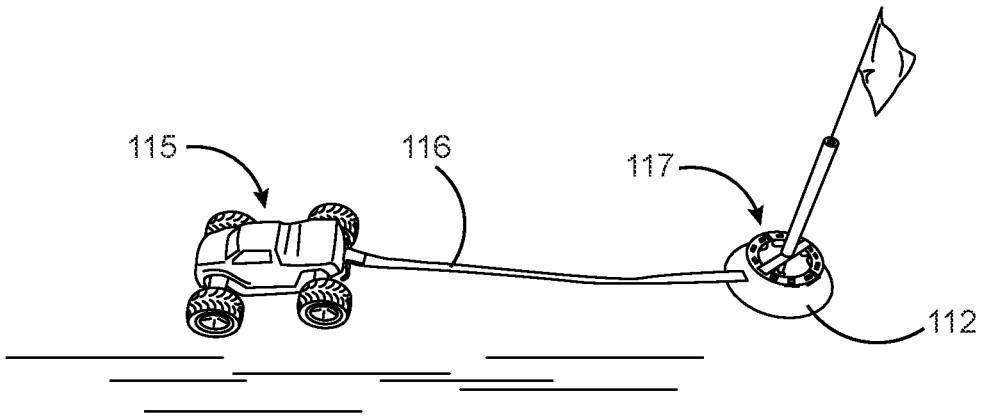
FIG. 12 illustrates a side perspective view of a remotely controlled vehicle having a tow strap attached to the portable ball trap in accordance with the preferred embodiment of the present invention.

FIG. 12 illustrates an optional remotely controlled vehicle 115 having a tow strap 116 attached to the portable ball trap 117. The remotely controlled vehicle 115 having the tow strap 116 is configured to remotely position the portable ball trap 117 on the hard surface. The embodiment of the tow strap 116 is relatively flat so as to have a minimal effect on a ball rolling over it. The tow strap 116 is also easily detachable from the portable ball trap 117 for putting when desired. The attachment and detachment are accomplished using a hook and loop type material 129 or very low profile mechanical connectors on the tow strap 116 and corresponding parts on the thin flat platform 112 of the portable ball trap 117. Alternative embodiments for attaching the remotely controlled vehicle 115 to the portable ball trap 117 could include cables or bars with hook or snapped on swivel attachment points.

The optional remotely controlled vehicle 115 allows for ease of playing and simulating the game of golf by positioning the portable ball trap 117 remotely. Using the remotely controlled vehicle 115 for portable ball trap 117 placement allows the players to set the location of the next ball trap 117 at some suitable distance down the street and in conditions with the desired degree of challenge. After the players have completed the game in a particular location, the next location can be set remotely in a like manner without having to walk down the street and back, to place the portable ball trap 117 manually. This allows for unique pathways and course layouts through a neighborhood each time the game is played. Navigating the remotely controlled vehicle 115 with the portable ball trap 117 down the street using the remotely controlled vehicle 115 is fun, sometimes challenging, and adds to the overall enjoyment of the game. The portable ball trap 117 can also be driven onto the sidewalk or other accessible areas to provide more variety.

Figure 13:
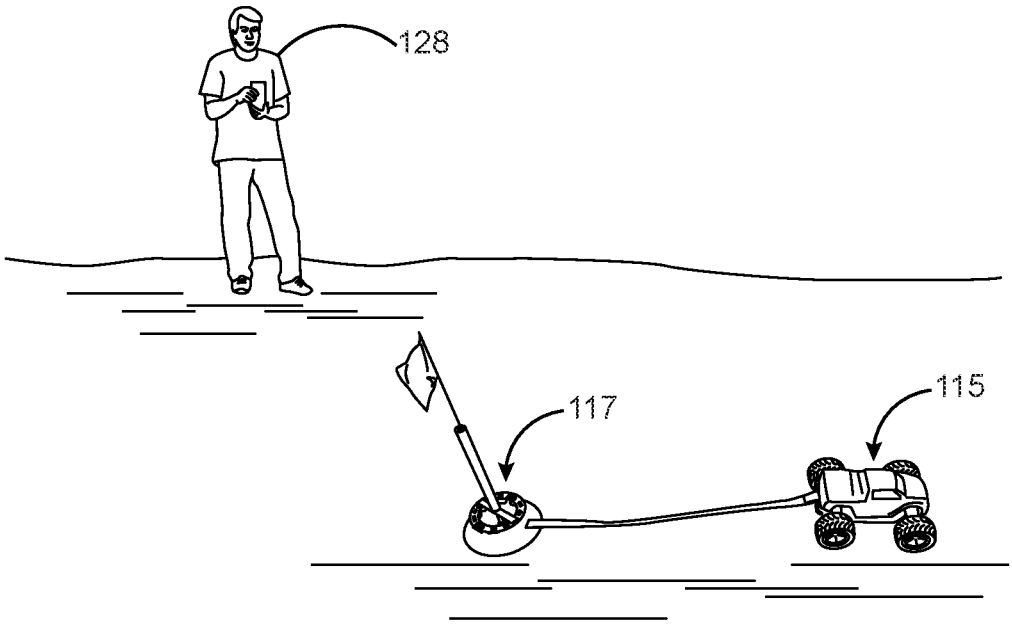
FIG. 13 illustrates a side perspective view of positioning the portable ball trap utilizing the remotely controlled vehicle in accordance with the preferred embodiment of the present invention.

FIG. 13 illustrates positioning the portable ball trap 117 utilizing the remotely controlled vehicle 115. The portable ball trap 117 attached to the flat tow strap 116 of the remotely controlled vehicle 115 is being piloted by a player 128 to a desired location. The remotely controlled vehicle 115 allows customization of the portable ball trap location without the need for the player 128 to physically leave the start or "tee-off" point. By allowing positioning of the portable ball trap 117 to the next location after completion of play at the current location, the remotely controllable vehicle 115 provides for a sequential series of the portable ball trap locations at different distances and placement to be enjoyed in a manner similar to that of conventional golf.

Figure 14:
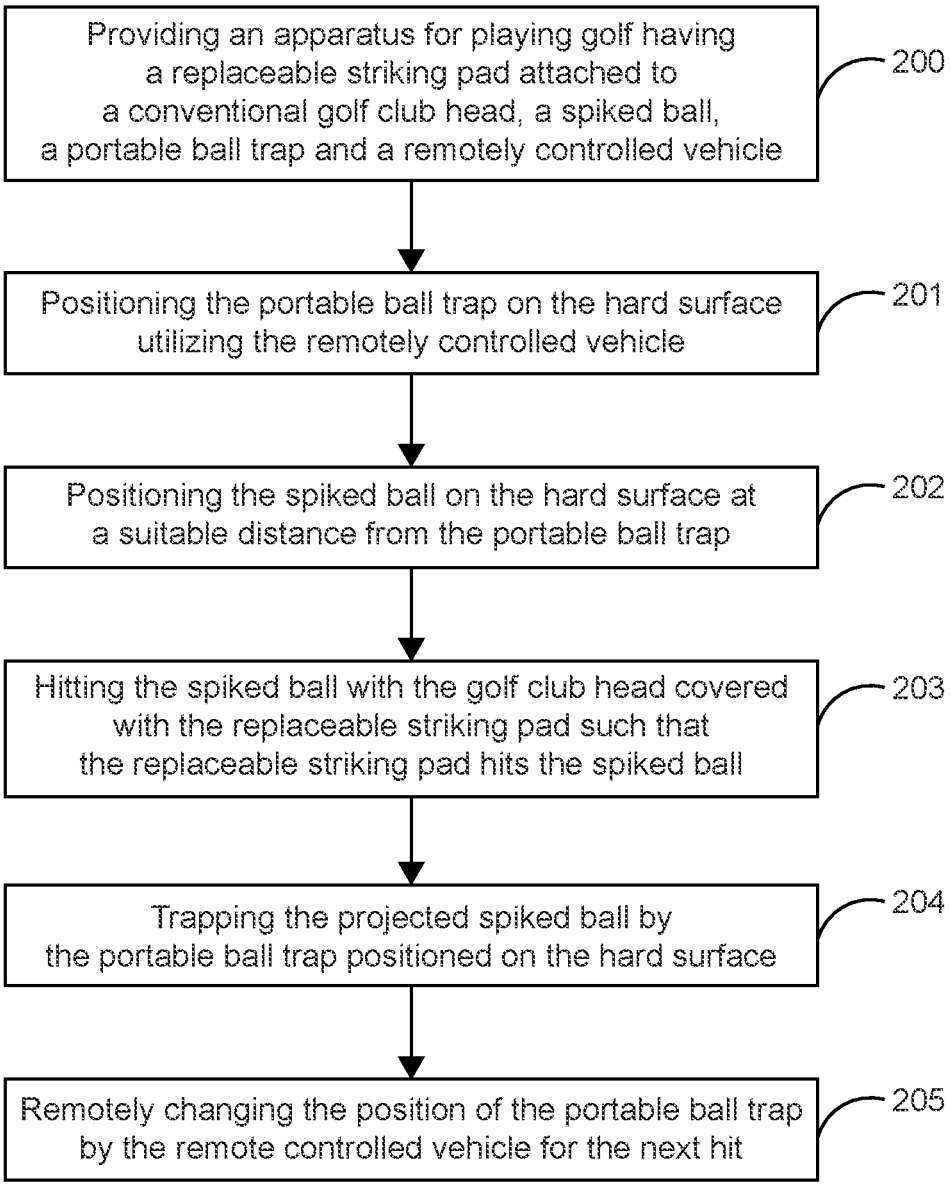
FIG. 14 is a flowchart of a method for playing golf on a hard surface utilizing the present apparatus in accordance with the preferred embodiment of the present invention.

FIG. 14 is a flowchart of a method for playing golf on a hard surface utilizing the present apparatus in accordance with the preferred embodiment of the present invention. The method for playing golf on a hard surface comprises the steps of: providing an apparatus for playing golf having a replaceable striking pad attached to a conventional golf club head, a spiked ball, a portable ball trap and a remotely controlled vehicle as indicated in block 200. The portable ball trap is positioned on the hard surface, in one instance utilizing the remotely controlled vehicle as indicated in block 201 and positioning the spiked ball on the hard surface at a suitable distance from the portable ball trap as indicated in block 202. Hitting the spiked ball with the golf club head covered with the replaceable striking pad such that the replaceable striking pad hits the spiked ball as indicated in block 203. Trapping the projected spiked ball by the portable ball trap positioned on the hard surface as indicated in block 204. Then, the position of the portable ball trap may be remotely changed by the remote controlled vehicle for the next hit as indicated in block 205.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

I claim:

1. An apparatus for playing golf on a hard playing surface, the apparatus comprising:

a golf club head comprising a face, a bottom sole, a top side, and a back side having an upper back side;

at least one adjustable clamp adjustable in a plane parallel to the club head face;

a replaceable striking pad comprising a top end, a bottom end, a flat front face, a back face, and a holding ledge extending away from the bottom end adjacent the flat front face along the bottom sole of the club head towards the back face; and a flexible ball;

whereby the holding ledge of the replaceable striking pad protects the golf club head and the hard playing surface from damage when said hard playing surface is contacted by a user in the act of hitting the flexible ball, thereby allowing playing golf on the hard playing surface; and whereby said replaceable striking pad is attached to said golf club head by the at least one adjustable clamp and the holding ledge contacting said golf club head bottom sole and the replaceable striking pad back face in contact with the golf club head face, and wherein the adjustable clamp is movably adjustable along the replaceable striking pad.

2. The apparatus of claim 1 wherein the replaceable striking pad is made from a material with high toughness with ISO 179 Charpy notched impact of greater than 10 kJ/m at 23 degrees C., high wear resistance and a dynamic coefficient of friction less than 0.5 when tested on steel.

3. The apparatus of claim 1 wherein at least one clamp engages the upper back side of the golf club head to provide tension for engaging the flat front face of the replaceable striking pad.

4. The apparatus of claim 1 wherein the replaceable striking pad includes one or more slots extending above said top side of the golf club head to facilitate adjustment of the replaceable striking pad relative to the club head in the plane parallel to the club head face.

5. The apparatus of claim 1 further comprising an elastomeric cushion shaped to match a portion of an inside surface of the replaceable striking pad that provides dampening for the golfer, and improves the life of the replaceable striking pad for further reducing impact forces transmitted to the golf club head when impacting the hard playing surface.

6. The apparatus of claim 1 wherein the replaceable striking pad protects the club head and resists drag forces on an underside of the replaceable striking pad when in contact with the hard playing surface.

7. The apparatus of claim 1 wherein the replaceable striking pad further comprises a transition to a lip located along an underside of the replaceable striking pad front face at a leading edge of a vertex intersecting the holding ledge of the replaceable striking pad, enabling improved contact between the replaceable striking pad and an underside of the ball, thereby facilitating ball loft.

8. An apparatus for playing golf on a hard surface, the apparatus comprising:

a golf club head comprising a face, a bottom sole, and a back side having an upper back side;

a replaceable striking pad attached to the golf club head via at least one adjustable clamp adjustable in a plane parallel to the club head face, the replaceable striking pad further comprising a top end, a bottom end, a flat front face, a back face, and a holding ledge extending away from the bottom end adjacent the flat front face;

a spiked ball having a ball core, an underside in contact with the hard surface, and a plurality of flexible spikes covering a surface of the ball, said flexible spikes buckled partially where initially in contact with said hard surface, the plurality of flexible spikes providing static and rolling resistance to resist rolling on a 5 percent slope; whereby the replaceable striking pad protects the golf club head during play on the hard surface; and whereby said replaceable striking pad is attached to said golf club head by the at least one adjustable clamp and the holding ledge contacting said golf club head and the replaceable striking pad back face in contact with the golf club head face, and wherein the at least one clamp is movably adjustable along the replaceable striking pad.

9. The apparatus of claim 8 whereby when applied to the golf club head, the replaceable striking pad is adaptable to extend under the bottom sole of the golf club head, and is adjustable in a plane of the club head face, including one or more clamps that firmly engage the upper back side of the club head, thereby restraining movement of the replaceable striking pad relative to the golf club head.

10. The apparatus of claim 8 further comprising a portable ball trap target having a thin, flat platform with tapered edges that rest on the hard surface and an attached elevated circular frame adaptable to hold and trap the spiked ball and prevents backward motion, the tapered edges allow the ball to enter into the thin flat platform.

11. The apparatus according to claim 8 wherein the plurality of flexible spikes lifts the ball core above the hard surface, thereby allowing the bottom end of the replaceable striking pad front face to contact the underside of the ball core when the golf club head is swung.

12. The apparatus of claim 8 wherein a lip at the bottom end adjacent the front face of the replaceable striking pad at a leading edge of a vertex intersecting the holding ledge of the replaceable striking pad enables improved contact with the underside of the spiked ball and better ball loft.

13. The apparatus of claim 8 wherein the plurality of flexible spikes on the spiked ball allows lifting of the ball off the hard surface, striking by the club head, and provides smooth and straight rolling characteristics, with said characteristics facilitated by having more than 100 flexible spikes and utilizing an elastomeric material softer than 50 Shore A hardness.

14. A method for playing golf on a hard surface, the method comprising the steps of:

a) providing an apparatus for playing golf, the apparatus comprising a replaceable striking pad attached to a golf club head by at least one adjustable clamp adjustable in a plane parallel to a club head face, the replaceable striking pad including a top end, a bottom end, a flat front face, a back face, and a holding ledge having curved bottom sides and extending away from the bottom end adjacent the front face along a bottom sole of the club head towards or beyond the back face, whereby said replaceable striking pad is attached to said golf club head by the at least one adjustable clamp and the holding ledge contacting the golf club head bottom sole and the replaceable striking pad back face in contact with the golf club head face; the adjustable clamp being movably adjustable along the replaceable striking pad;

b) providing a flexible ball comprising a ball core and a plurality of flexible spikes covering a surface of the flexible ball, and which are buckled partially where initially in contact with the hard surface, and which are configured to lift the flexible ball off the hard surface to absorb irregularities in the hard surface and provide smooth rolling characteristics;

c) identifying a target or direction of travel for said ball;

d) positioning the ball on the hard surface; and e) hitting the ball in the direction with the golf club head covered with the replaceable striking pad such that the replaceable striking pad hits the ball.

15. The method according to claim 14 wherein the plurality of flexible spikes lifts the ball core above the hard surface, thereby allowing the bottom end adjacent the front face of the replaceable striking pad to contact an underside portion of the ball when the golf club head is swung.

16. The method according to claim 14 wherein the plurality of flexible spikes on the ball buckles while rolling or at rest to provide sufficient static rolling resistance to resist rolling on a 5 percent slope.

17. The method according to claim 14 whereby positioned on the hard surface is a portable ball trap to trap the hit spiked ball, whereby the portable ball trap is positioned using a remotely controlled vehicle.

* * * * *